US005482009A

United States Patent [19]

Kobayashi et al.

[11] Patent Number: 5,482,009

[45] Date of Patent: Jan. 9, 1996

[54] COMBUSTION DEVICE IN TUBE NESTED BOILER AND ITS METHOD OF COMBUSTION

[75] Inventors: Hiroshi Kobayashi; Yoshiharu Ueda; Masanari Kinoshita; Masamichi Yamamoto; Atsumi Kaminashi, all of Osaka, Japan

[73] Assignee: Hirakawa Guidom Corporation, Osaka, Japan

[21] Appl. No.: 201,419

[22] Filed: Feb. 24, 1994

[30] Foreign Application Priority Data

Feb. 25, 1993 [JP] Japan ..... 5-063522

[51] Int. Cl.[6] ..... F22B 23/06

[52] U.S. Cl. ..... 122/367.1; 122/367.3; 122/235.11; 122/4 D

[58] Field of Search ..... 122/367.1, 367.2, 122/235.11, 235.23

[56] References Cited

U.S. PATENT DOCUMENTS

| | | | |
|---|---|---|---|
| 2,677,532 | 5/1954 | Huet | 122/367.3 |
| 2,840,043 | 6/1958 | Durham | 122/4 D |
| 4,465,025 | 8/1984 | Schroder | 122/235.11 |
| 4,538,551 | 9/1985 | Brady et al. | 126/367.1 |
| 5,020,479 | 6/1991 | Suesada et al. . | |
| 5,050,541 | 9/1991 | Kobayashi et al. | 122/367.1 |
| 5,216,981 | 6/1993 | Solomon et al. | 122/4 D |
| 5,259,342 | 11/1993 | Brady et al. | 122/367.1 |

OTHER PUBLICATIONS

Ishigai et al., "Jaggy Fireball in Tube–Nested Combustor: An Advanced Concept for Gas–Firing and its Application to Boilers", HTD–vol. 199, Heat Transfer in Fire and Combustion Systems ASME 1992, pp. 189–195.

*Primary Examiner*—Marguerite Macy
*Attorney, Agent, or Firm*—Wenderoth, Lind & Ponack

[57] ABSTRACT

In a combustion device, a boiler is provided with a water tube nest in which combustion, flame holding, fuel-air mixing, and heat absorption are carried out by each water tube in a tube nest. The arrangement of this combustion device enables elimination of the conventional burner and furnace. Fuel supply devices are provided upstream of the water tube nest to supply fuel or a fuel-air mixture. One or several combustion catalysts are provided across the gas flow direction in the boiler to promote combustion. In one arrangement, the fuel supply devices are fuel supply tubes, and fuel or fuel and air are supplied to the fuel supply tubes and spouted from fuel injection nozzles thereof. The fuel supply tubes and water tubes are arranged such that the row of fuel supply tubes is spaced upstream from the first water tube row, such that L≧3D where L is the pitch between the fuel supply tube row and the first water tube row, and D is the diameter of the water tubes. Also, P ≧2D where P is a longitudinal pitch between the water tube rows. A suitable number of fins having a suitable angle and height can be provided on the water tubes and/or the fuel supply tubes. U-shaped or other openings can be made in the fins.

18 Claims, 11 Drawing Sheets

COMBUSTION DEVICE IN TUBE NESTED BOILER AND ITS METHOD OF COMBUSTION

BACKGROUND OF THE INVENTION AND RELATED ART STATEMENT

1. Field of the Invention

The present invention aims to provide new combustion equipment for a water tube boiler with a tube nested combustion chamber, and a new combustion method to use the equipment, whereby NOx levels are controlled by burning fuel in the water tube nest under high intensity combustion and reduction of the boiler size and weight is attained by making the furnace extremely small. The invention is applicable to all types of boilers, such as Natural Circulation, Forced Circulation, and Once-Through Water tube boilers and Flue & Water tube boilers such as Vacuum Hot Water Boilers, Re-generators of Absorption type Refrigerators, Domestic Hot Water Heaters and Steam Generators, and Heat Exchangers (hereinafter, these are referred to as Boilers).

2. Description of the Prior Art

In conventional types of boilers, a furnace occupies most of the volume of the boiler, thereby undesirably affecting the performance and the cost of the boiler. Therefore, it is desirable to develop a small but highly efficient boiler.

The inventors have proposed and developed the following two methods to reduce the volume of the boiler occupied by a furnace to nearly zero. One of the methods is a so called "High Intensity Surface Combustion Method" which attains high intensity surface combustion by use of a pre-mixed burner 12', (Japanese Patent Application No. S60-205104, refer to present drawing FIGS. 11 & 12). The second of the methods is a so called "Tube Nested Combustion Chamber Method" in which the combustion and heat transfer are attained by causing the flame 11' from the burner 12' to penetrate into the nest of tubes 1' (Japanese Patent No H2-272207, present drawing FIGS. 13 & 14).

SUMMARY OF THE INVENTION

However, there were some technical problems to be solved in the "High Intensity Surface Combustion Method" and the "Tube Nested Combustion Chamber Method" as follows:

A) High Intensity Surface Combustion (extremely short flame) Method:

This method aims to reduce the relative volume of the boiler's furnace by increasing the combustion capacity per unit volume. However, as this concept is used to greater extents, the shorter the flame must be so as to not hit the burner flame 11' against the nest of water tubes 1'. In order to shorten the flame, it is necessary to increase the power of the forced air fan for combustion, thereby giving rise to problems such as unstable combustion, vibration, noise or damage of water tubes due to uneven local heat flux caused by rising temperatures of gas at the furnace outlet resulting from a decrease in the convective heat absorption rate. Among these problems, the production of NOx, for example, can be solved by pre-mixing to give lean combustion, but this results in a problem with respect to energy savings, because of an increase in sensible heat loss of exhaust gas. Thus, there is a limit to the effectiveness of this method in overcoming these technical problems.

B) Tube nested Combustion Chamber Method:

In the tube nested combustion chamber method by the five (5) inventors of the present invention, wherein a combustion flame is formed in the water tube nest, it is theoretically possible to attain a reduction in boiler size and weight by actually eliminating the furnace to promote combustion and heat transfer in the tube nest, and also to reduce NOx levels by reducing the combustion temperature through heat absorption of the water tube nest. However, the performance is significantly affected by characteristics of the burner, because the flame is blown into the water tube nest close to the burner. Problems with this include there being a narrow combustion range, a narrow turn-down, and a tendency toward pulsating combustion and combustion noise. It was considered necessary to obviate these problems for the purpose of combusting fuel in the tube nest.

Both of the above mentioned methods A) & B) utilize a burner to cause flame holding and mixing, and a tube nest to cause combustion and heat transfer separately. Therefore, it is imperative to provide these functions for the purpose of reducing boiler size and weight, and achieving high efficiency. This was the basic problem to be solved by the present invention.

In a conventional burner, the combustion flame is formed from the surface of a flame holder. The flame tends to lift or vibrate in the case of poor flame holding. Moreover, the mixing of fuel and combustion air is influenced by the burner design. Even if the mixing is promoted in a water tube nest, it will be only local mixing by Karman vortices on a small scale. Such a burner having an uneven air ratio has fluctuation in the gas passage through the tube nest, and thus the flame should be longer due to the poor mixing. Also, unburned gas or CO are exhausted without re-burning. The present invention endeavors to make a fundamental improvement of the former "Tube Nested Combustion Chamber Method" invented by the present inventors, to solve the above mentioned problems. The burner section and the water tube nest of the boiler itself are not separated. By combining these functions into one unit, a wide combustion range, a wide turn-down, stable combustion and low noise are achieved. The present invention provides such integrated combustion equipment having a burner, and the combustion method to use the equipment.

DETAILED DESCRIPTION OF THE INVENTION

Figure 1A:
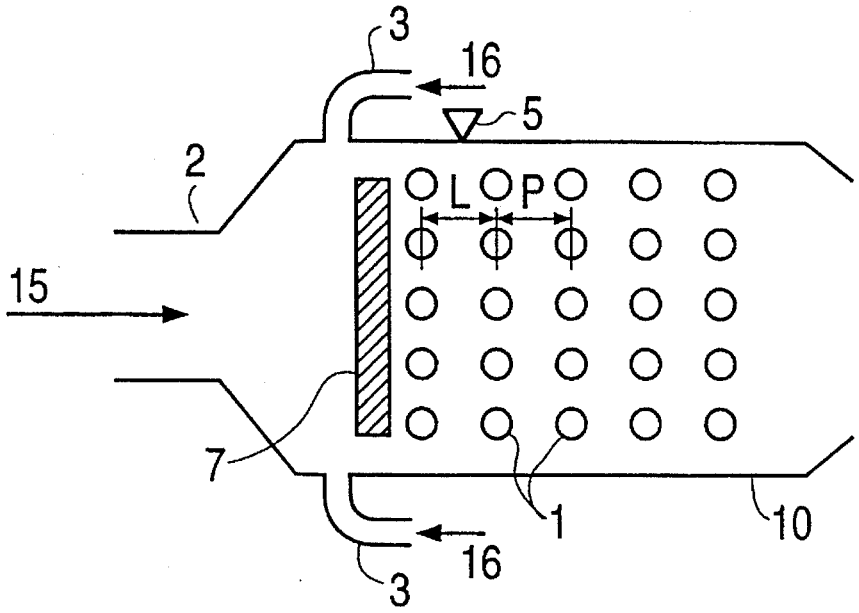
FIGS. 1A, 1B and 1C show three variations of a boiler utilizing a fuel supply device according to one aspect of the present invention.

In the present invention, a combustion device consists of a combustion air supply device and a fuel supply device, or an air-fuel mixture supply device, and any of a variety of types of combustion media, rather than a combustion burner in a conventional boiler. Where combustion, flame holding, and mixing are caused by each of the water tubes and the combustion medium in the tube nest, the combustion reaction is better promoted by one or several combustion media arranged along the gas flow direction in the water tube nest. This promotion comes from a synergistic effect whereby mixing is promoted by the combustion medium and the water tubes themselves.

Each combustion medium is planar or corrugated and is made of a porous or honeycomb combustion catalyst. Good combustibility and an even heat flux distribution are obtained by providing a uniform air ratio distribution in front of the water tube nest by arrangement of a fuel supply device or an air-fuel mixture supply device and the combustion air supply device. A good arrangement is one in which the fuel or pre-mixed fuel supply device is designed with fuel supply tubes having almost the same diameter as that of the water tubes and being set in the same arrangement as the tube nest at the front side of the tube nest and/or between water tube rows. The fuel injection nozzles are arranged with almost the same pitch as the water tubes along the tube axis.

A longitudinal pitch L between a row of the fuel supply tubes and the first water tube row shall be set so that $L \geqq 3D$, where D is the diameter of the water tube or fuel supply tube, in order to provide even combustion gas distribution to the next (in the downstream direction) tube nest. Moreover, it is better to make $P \geqq 2D$, where P is the longiutdinal pitch between the water tube rows and D is the diameter of the water tubes or fuel supply tubes. When $L<D$ or $P<2D$, it becomes difficult to promote mixing of the flame by Karman vortices (K), and thus, uniform distribution of the combustion gas is not achieved. Another example of tube design and arrangement is a case in which fins are fitted on the water tubes in order to improve flame holding on the fuel supply device or pre-mixed fuel supply device regardless of the diameter and arrangement of the tubes. When using finned tubes, it is better to make $L \geqq 3(Dn+2h)$, where L is the longitudinal pitch between the fuel supply tube and the first water tube row, Dn is the diameter of the fuel supply tube, and h is the height of the fin. In any case, the fuel supply tube or pre-mixed fuel supply tube can be made of a combustion catalyst. Also, a double tube can be used for the fuel supply tube.

The boiler applied in the former "Tube Nested Combustion Chamber Method" invented by the present inventors, is equipped with a combustion burner. In this case, combustion, flame holding, and a part of the mixing process of the fuel and air are carried out at the burner, and fluid mixing by each water tube in the tube nest promotes combustion and heat transfer in the furnace. A feature of the present invention is that the combustion, flame holding, and mixing are performed in the tube nest to substitute for the conventional burner, as a solution to the above mentioned problems.

The present invention carries out the combustion, flame holding, and mixing functions which have been previously carried out by combustion burners. This means that fuel or partially premixed fuel is mixed with combustion air in the tube nest and/or the combustion medium, and then the combustion reaction is carried out there. At the same time, combustion, flame holding, and mixing takes place downstream of each water tube. In the present invention, each water tube functions as a high performance flame holder due to its bluff body effect. Also, fluid mixing is promoted by Karman vortices (K) in spaces between water tubes rows by adjusting the water tube arrangement. Therefore, the water tube nest carries out the important functions of flame holding and mixing of the combustion burners used by conventional burners. The important feature of the present invention is to concurrently provide combustion and heat absorption in the same water tube nest.

Figure 2:
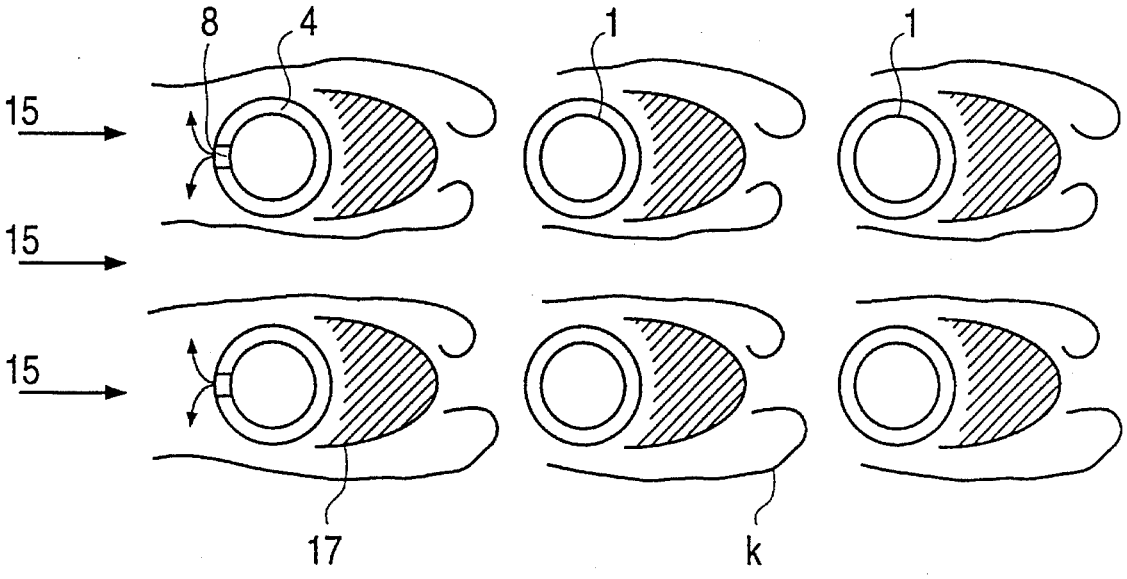
FIG. 2 is a conceptual illustration of flame holding at water tubes according to the present invention.

Each flame is held in a stagnant part (or flame holding area) (17) of the water tube wake, as shown in FIG. 2. Mixing air and fuel is promoted by Karman vortices (K) formed in a space between each of the water tubes, and thereby, combustion, flame holding, and heat transfer are promoted. This phenomenon occurs repeatedly from the first tube row until the last tube row, so as to achieve complete combustion. Moreover, combustibility is improved by the rapid promotion of the combustion reaction, by inserting combustion medium between water tube rows, or by using a fuel supply device which also functions as a combustion medium (catalyst). The bluff-body function for holding the flame, as carried out by the water tubes and/or the fuel supply tubes, is enhanced, by using the proper number, height, and angle of the fins on the fuel supply tube. Formation of U-shaped or square openings, or holes of a proper diameter on the fins will improve the effectiveness.

EXAMPLES

The present invention will now be described in greater detail with reference to the drawing figures and by way of example.

Example 1

As shown in FIG. 1A, combustion air (15) is supplied to a boiler (10) by a forced air fan through a combustion air supply device (2) with equal gas flow velocity. On the other hand, fuel (16) is supplied from fuel supply devices (3) into a nest of tubes (1) (i.e. a tube nest) in directions orthogonal to the combustion air stream, and is mixed with combustion air (15) before entering into the tube nest. After that, the air-fuel mixture is ignited by an ignition device (5) located at or near the first water tube row. In this manner, a flame is maintained at the back side (i.e. in a flame holding are (17)) of each tube as shown in FIG. 2, and combustion and heat transfer are carried out in the tube nest. Flames are not created in a mixing area (7) at the front of the first tube row because there is no stagnant space (or flame holding area) present there.

The above-described arrangement is of a simple structure. However, the problem of uneven combustion remains due to poor mixing.

The following are methods of supplying fuel to fuel supply devices:

1. Only fuel is supplied to a fuel supply device as shown in FIG. 1A.

Figure 1B:
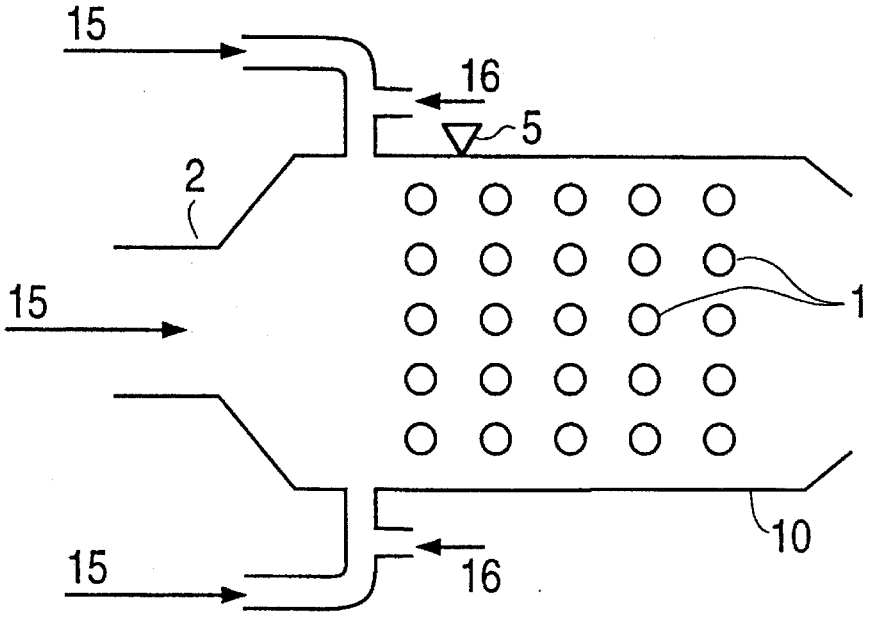

2. Fuel is pre-mixed with combustion air in a fuel supply device, and the fuel-air mixture is mixed with further combustion air, as shown in FIG. 1B.

Figure 1C:
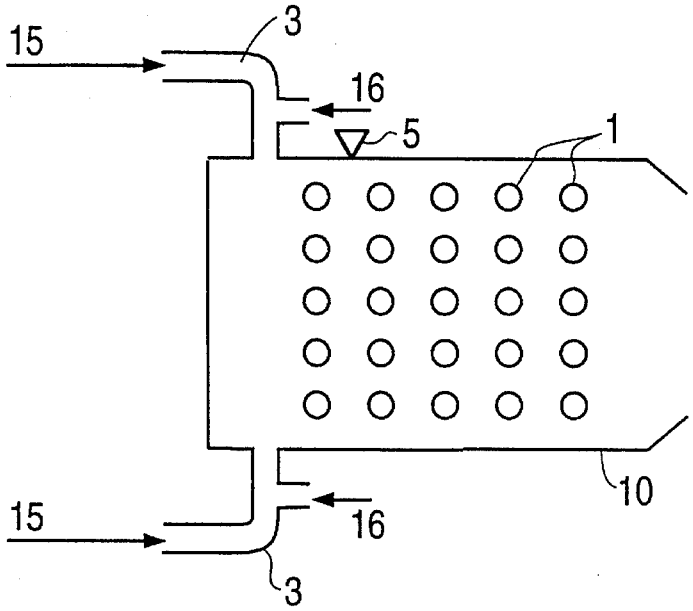

3. Fuel is pre-mixed with the full required amount of combustion air in a fuel supply device, as shown in FIG. 1C.

The most suitable of these three methods can be chosen to best fit a particular need.

Example 2

Further improved fuel supply methods and apparatus are shown in FIGS. 3A–3F, FIGS. 4A–4G, FIGS. 5A–5E, FIG. 6, FIG. 7, FIG. 8 and FIG. 9.

Figure 3A:
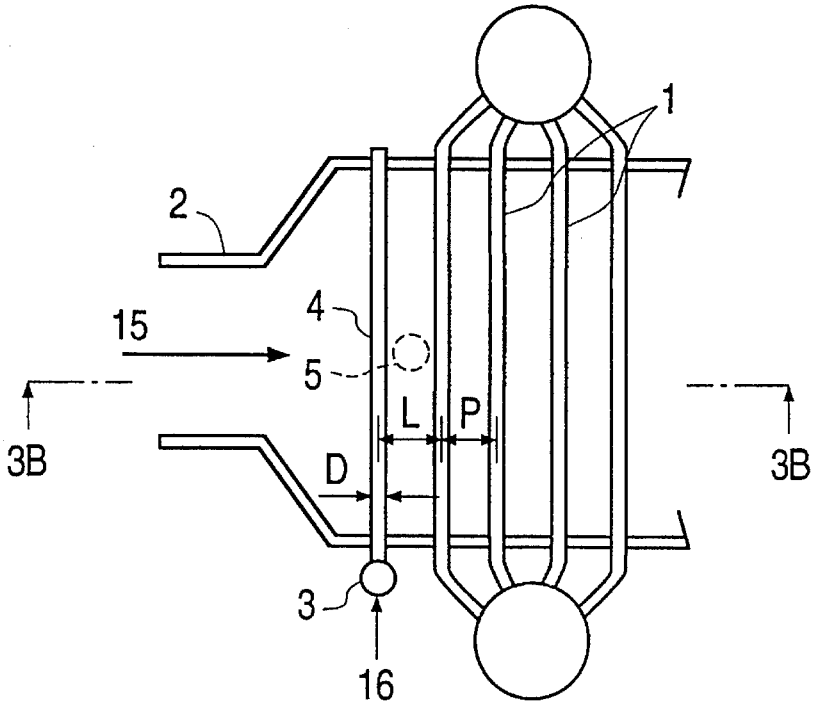
FIGS. 3A and 3B, FIGS. 3C and 3D, and FIGS. 3E and 3F show side and plan views of three variations of a boiler utilizing a fuel supply device according to a second aspect of the present invention.

A uniform flow of combustion air is supplied into the mixing space in front of the tube nest through a combustion air supply device as shown in FIG. 3A, in the same manner as described in connection with FIG. 1A. In the FIG. 3A arrangement, the fuel is supplied from a fuel supply device into the mixing space, and the fuel supply device is constituted by fuel supply tubes 4. The diameters of the tubes of the fuel supply device are almost the same as those of the water tubes. A row of the fuel supply tubes of the fuel supply device described above is disposed in the same arrangement as a row of the water tubes (1) and at the front (or upstream side) of the tube nest. In an alternative arrangement, as shown in FIG. 9, rows (41, 42) of fuel supply tubes can also be disposed between water tube rows.

Figure 3B:
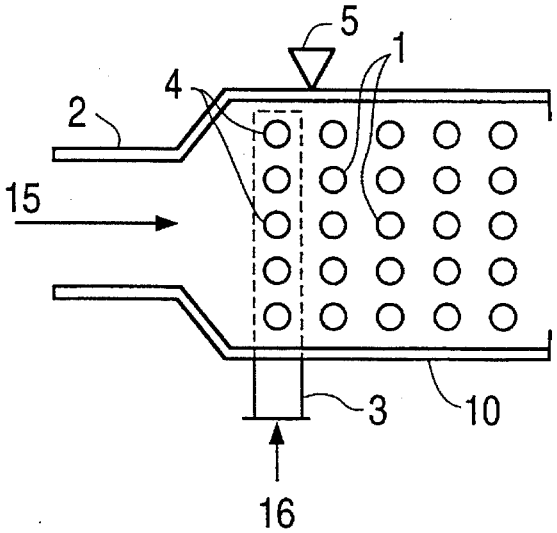
Figure 9:
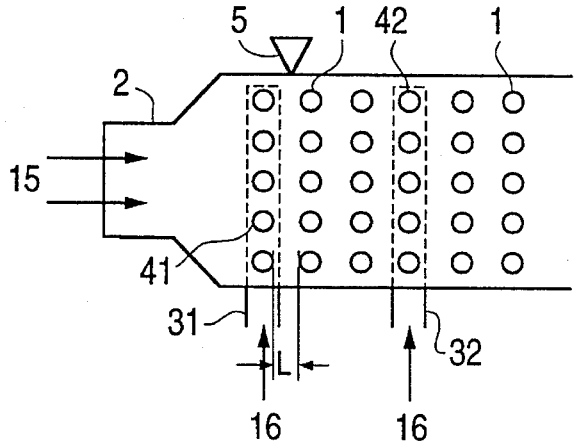
Figure 11:
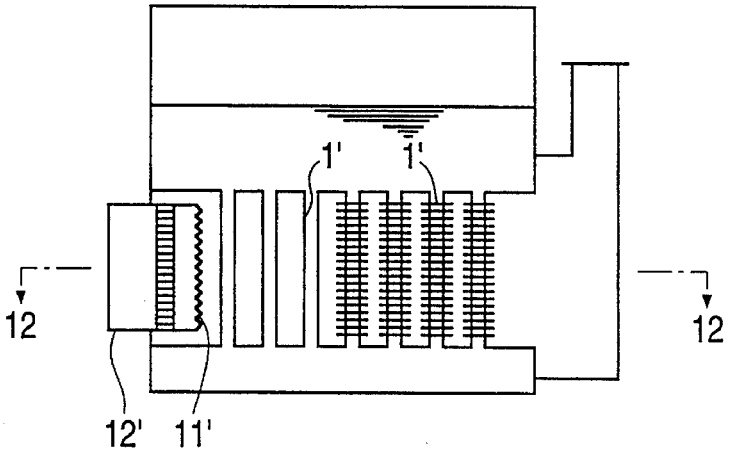
FIG. 11 PRIOR ART
FIGS. 11, 12, 13 and 14 illustrate prior art boilers.
Figure 12:
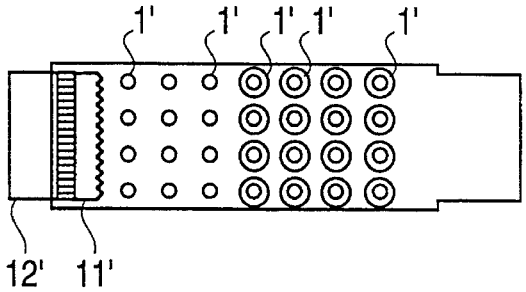
FIG. 12 PRIOR ART

A longitudinal pitch L between the fuel supply row and the first water tube row shall be set so that $L \geqq 3D$, where D is the diameter of the water tubes or fuel supply tubes in order to evenly distribute combustion gas to the tube nest shown in either FIG. 3A or FIG. 9. FIG. 3B is a sectional view taken along line 3B—3B of FIG. 3A.

Figure 3C:
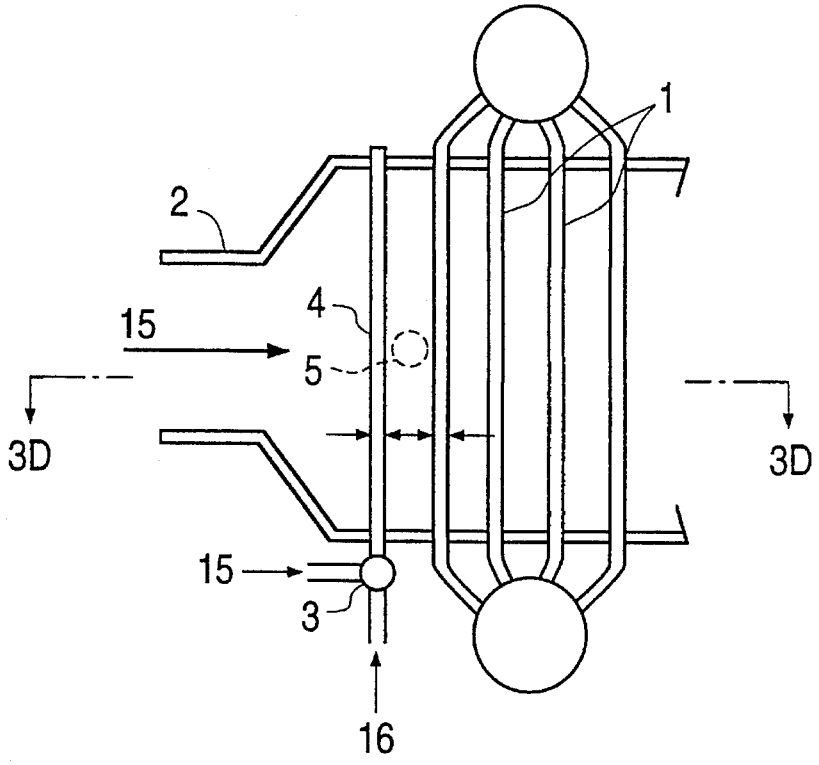
Figure 3D:
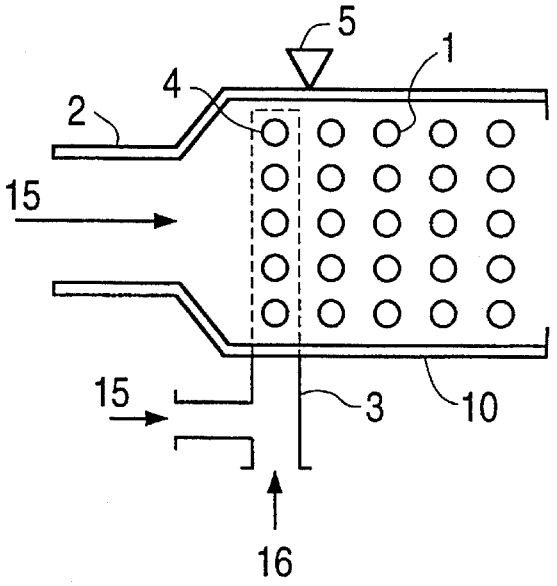

FIG. 3C shows a partially pre-mixed fuel supply (i.e. which supplies an air-fuel mixture having only part of the air required for combustion) similar to that shown in FIG. 1B but utilizing fuel supply tubes. FIG. 3D is a sectional view taken along line 3D—3D of FIG. 3C.

Figure 3E:
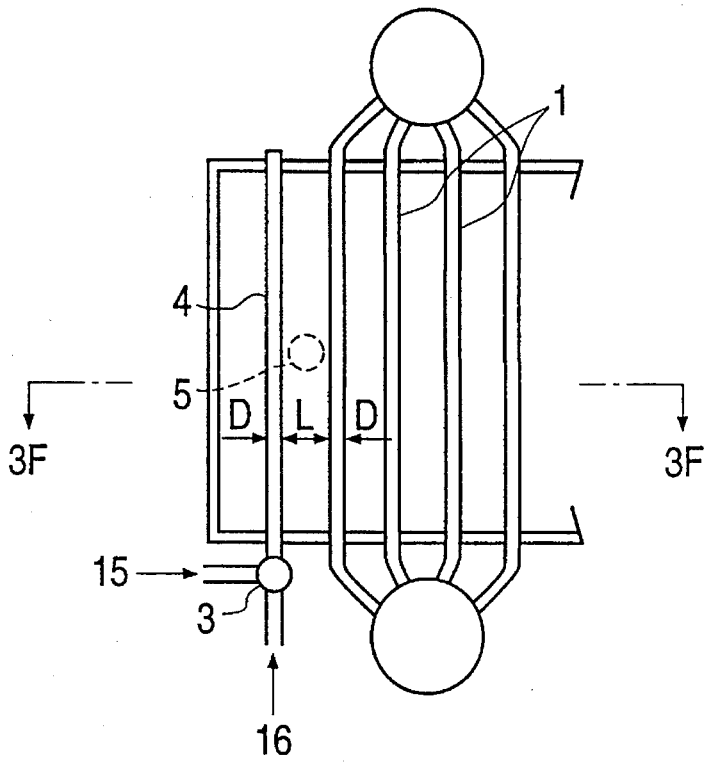
Figure 3F:
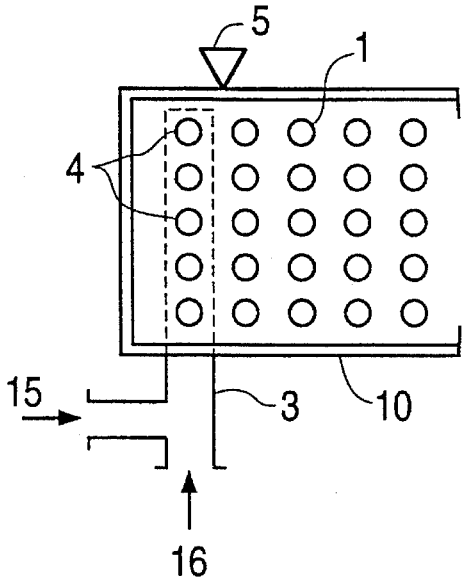

FIG. 3E shows a fully pre-mixed fuel supply (i.e. which supplies a fuel-air mixture having all of the air required for combustion) similar to that shown in FIG. 1C, but utilizing fuel supply tubes. FIG. 3F is a sectional view taken along line 3F—3F of FIG. 3E.

Figure 4A:
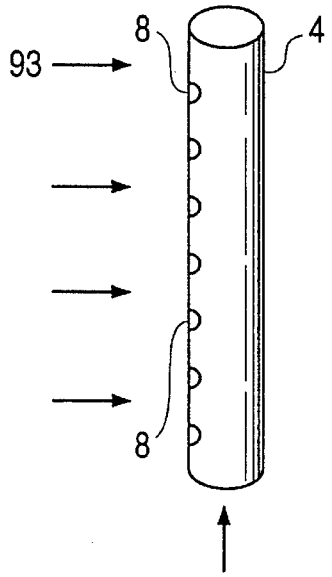
FIGS. 4A–4G show variations of fuel supply tubes according to the present invention.
Figure 4B:
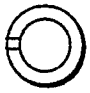
Figure 4C:
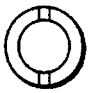

As shown in FIGS. 4A–4C, fuel is injected from fuel injection nozzles with almost the same pitch along the tube axis. It is advantageous, for better mixing conditions and flame holding in the fuel supply tube wake, to set up the nozzles so that they inject fuel in the direction opposite the direction (93) in which the combustion air flows. In this manner, an even air ratio distribution and uniform combustion are achieved at all sections of the tube nest, a flame is held at each water tube wake, and mixing is promoted by Karman vortices. This leads to even low temperature combustion due to uniform combustion, flame holding, and heat transfer. Finally, low NOx production is achieved.

A variety of structures of fuel supply tubes are shown in FIGS. 4D and 4E, FIGS. 4F and 4G, FIG. 5A, FIG. 5B, FIG. 5C, FIG. 5D, and FIG. 5E. A combination of the above-described structures may also be used. In any case, stable and low noise combustion can be attained without pulsating combustion and lifting of the flame, because the flame holding surface is much larger than that of the conventional boiler equipped with a combustion burner.

A conventional burner has a large air ratio distribution in section, and the burner-jet impinges on the tube nest at high velocity. This causes burn out of the water tubes, heat fatigue and corrosion fatigue due to uneven heat transfer load distribution. The present invention obviates these problems.

Moreover, the present invention can produce the same amount of energy with less fan power, because the present invention has a smaller draft loss than that of a conventional burner.

Figure 4D:
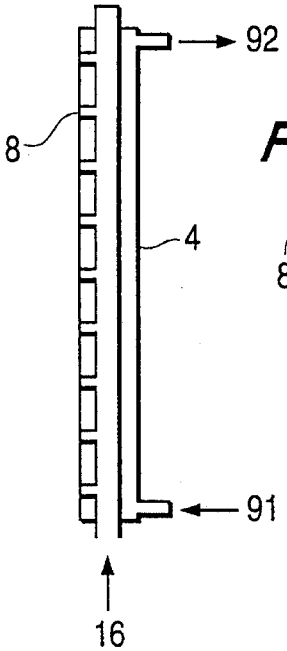
Figure 4E:
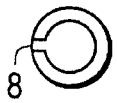

Unlike the water tube, the fuel supply tube might be subject to heat strain because it is cooled by combustion air at the front (upstream) side but is heated at the rear (downstream) side by the flame. Thus., it can be advantageous to utilize a water cooled double tube structure for the fuel supply tube, as shown in FIGS. 4D and 4E. In FIGS. 4D and 4E, a fuel supply tube (4) is of a double tube structure. The fuel supply tube (4) is provided with fuel injection nozzles and an inlet (91) and an outlet (92) for the cooling water.

Figure 4F:
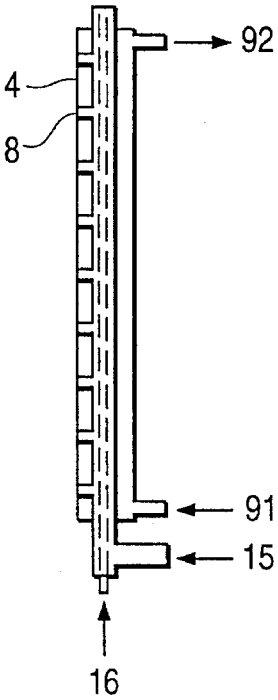
Figure 4G:
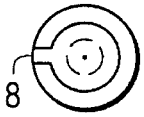

FIG. 4F shows a fuel supply tube (4) of a triple tube structure, which is similar to the double tube structure shown in FIG. 4D except that air (15) is mixed with the fuel 16 in the inner tube. This structure is an applicable example which enables safer design suitable for a large boiler.

When $P \geqq 2D$, where P is the longitudinal pitch between the water tube rows and D is the diameter of the water tubes, mixing of the air with the fuel is promoted by forming Karman vortices, and thus combustibility and heat transfer are enhanced. If $P<2D$, Karman vortices are not formed, thereby resulting in poor mixing.

Example 3

Figure 6:
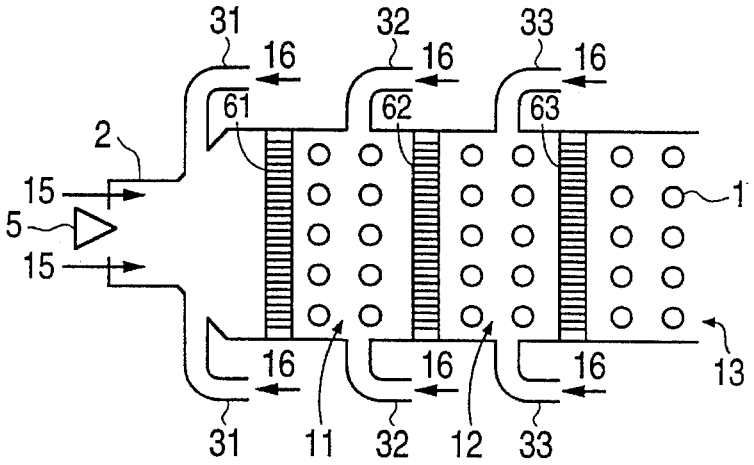
FIGS. 6, 7, 8 and 9 show variations of boilers according to the present invention.

FIG. 6 shows another example of the present invention, wherein a combustion medium consisting of a combustion catalyst or the like is used. Combustion catalysts, which have heat resisting temperatures of less than 1300° C., have not been used for conventional boilers because the flame temperature partly reaches 1500° C. to 1800° C. in the conventional boilers. In the present invention, however, gas temperatures in the boiler can be kept uniformly below 1300° C. due to uniform combustion, thereby making it possible to utilize a combustion catalyst. Thus, the performance of the present invention can be enhanced further by utilizing a combustion catalyst.

As shown in FIG. 6, one to several combustion mediums (61), (62), and/or (63) are arranged independently in front of and/or between groups (11, 12, 13) of water tubes (1). An ignition burner (5) is provided upstream of the medium, where combustion is promoted on the combustion medium surface, to preheat the air such that the temperature of the combustion air is increased to 400° C. At the front of the first combustion medium (61), all of the required fuel can be supplied by the primary fuel supply device (31). Each combustion medium (61), (62) and (63) is designed to acquire a combustion temperature between 1000° C. and 1200° C. at the outlet of each medium by adjusting a thickness of each combustion medium. (The thickness of the medium is approx. 20 mm in general). The gas temperature is reduced to 800° C. to 1000° C. in each tube nest group (11), (12), (13) where combustion, mixing, and heating transfer are carried out. Thanks to the above-described structure, low temperature combustion and low NOx values of 10 to 20 ppm are achieved. Moreover, the combustion range is widened, thereby resulting in low excess-air ratio combustion wherein the $O_2$ (oxygen) concentration in the exhausted gas is less than 1% due the combustion medium effect such that the energy savings are enhanced.

While it is described above that the first fuel supply device (31) at the front of the first combustion medium (61) solely supplies all of required fuel, it is also possible to provide a secondary fuel supply device (32) at the front of the combustion medium (62), and a tertiary fuel supply device (33) at the front of the combustion medium (63), to supply fuel in a stepwise manner to each tube nest group (11, 12, 13). In this case, it is best to provide each combustion medium with a suitable thickness for achieving complete combustion in each tube nest group. The fuel supplied to each fuel supply device can be either fuel premixed with part of the required combustion air (e.g. as in FIG. 1B), fuel premixed with all of the required combustion air (e.g. as in FIG. 1C), or fuel without combustion air (as in FIG. 1A). This depends on the boiler design.

Figure 7:
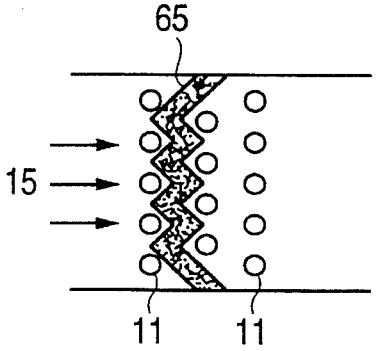

FIG. 7 shows a corrugated combustion medium, which is advantageously used when the planar combustion medium shown in FIG. 6 has insufficient strength to withstand thermal expansion and/or thermal stress, and/or when a larger surface area of the medium is required.

Figure 8:
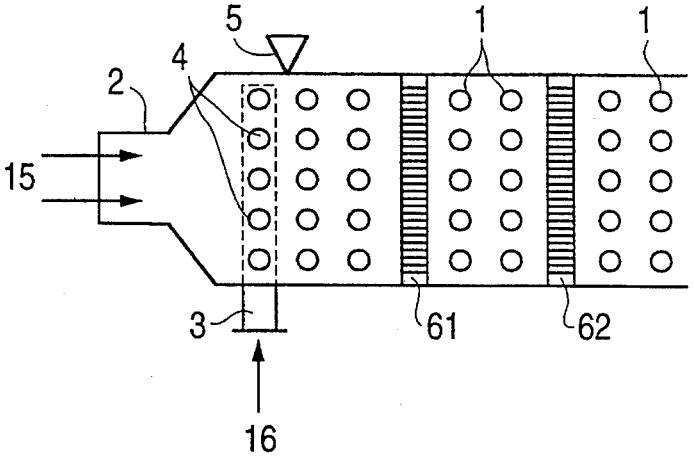

In a variation of the FIG. 6 example of the present invention, as shown in FIG. 8, fuel is supplied equally over the entire gas flow sectional area by using fuel supply tubes (4). This provides uniform combustion and heat transfer distribution over the entire sectional area, such that the problem of damage to the water tubes and/or the combustion medium due to thermal stress is solved. In a further example of the present invention, as shown in FIG. 9, multiple fuel supply tube rows 31*a*, 32*a* are provided between the water tube groups, and each fuel supply tube can have one of the structures shown in FIGS. 4A–4G. The FIG. 9 arrangement can also be provided with a combustion medium from among those shown in FIGS. 5A–5E.

Thanks to those configurations, the combustion media (61), (62), and (63) shown in FIG. 6, FIG. 7, and FIG. 8, may be omitted, thereby simplifying the structure inside the boiler.

Figure 5A:
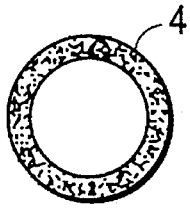
FIGS. 5A–5E show variations of fuel supply tubes formed of combustion catalyst, according to the present invention.
Figure 5B:
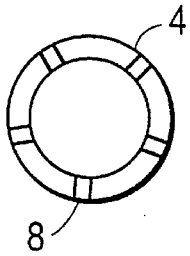
Figure 5C:
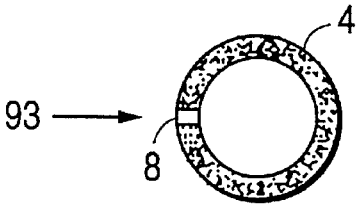
Figure 5D:
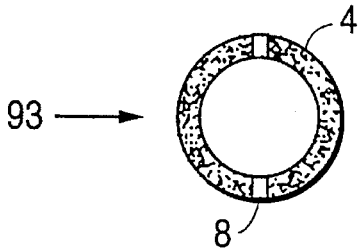
Figure 5E:
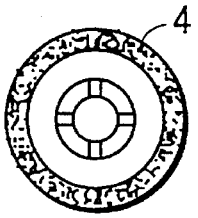

FIGS. 5A–5E show fuel supply tubes (4) similar to those shown in FIGS. 3A–3F and FIG. 9 but made of a combustion catalyst. FIG. 5A shows a fuel supply tube made of a combustion catalyst having a porous or honeycomb structure. FIG. 5B shows a fuel supply tube having a proper number of holes in its front side. FIG. 5C shows a fuel supply tube made of the same materials as shown in FIG. 5A and having fuel injection nozzles along the tube axis. The fuel is injected in a direction opposite to the direction (93) of the combustion air flow. FIG. 5D shows a fuel supply tube having nozzles aimed at right angles to the direction (93) of the air stream. FIG. 5E shows a fuel supply tube of a double tube structure, wherein the inner tube is for fuel supply. The fuel from the inner tube is mixed with combustion air from the outer tube. Then the fuel-air mixture is injected from the outer tube.

Example 2

Figure 10A:
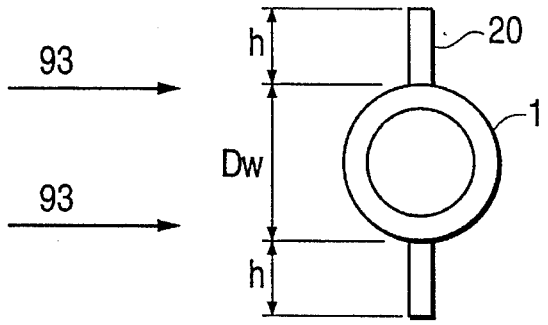
FIGS. 10A–10C show fin arrangements for tubes according to the present invention.
Figure 10B:
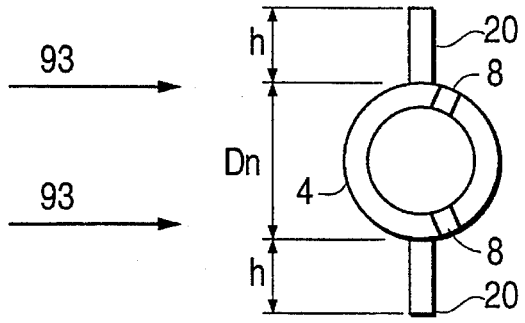
Figure 10C:
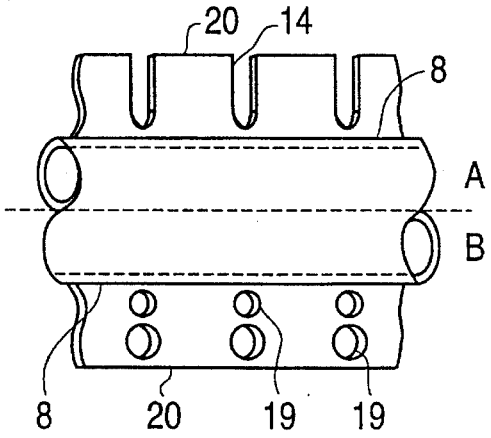
Figure 13:
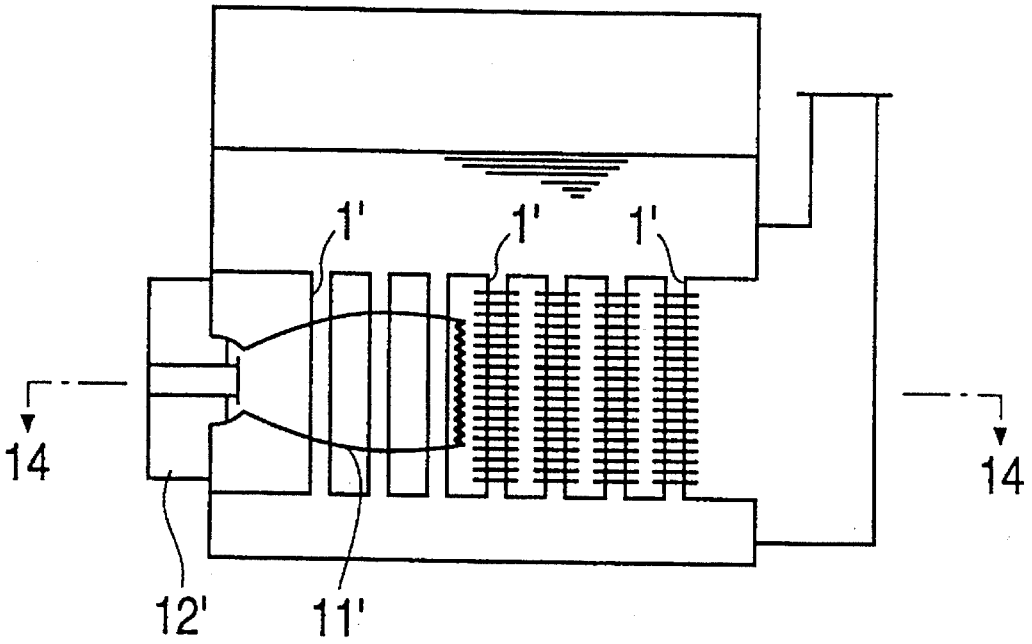
FIG. 13 PRIOR ART
Figure 14:
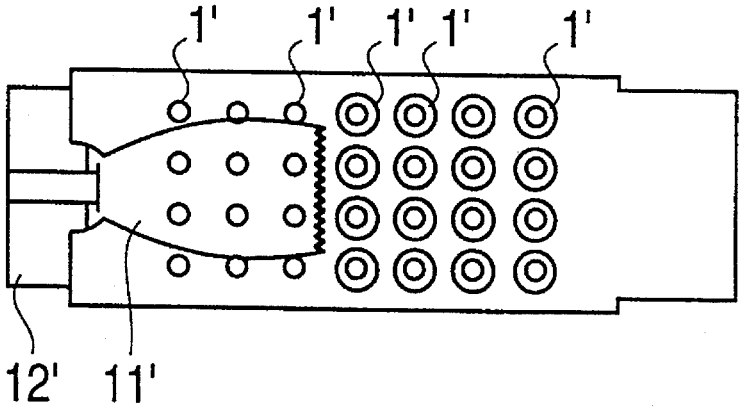
FIG. 14 PRIOR ART

FIGS. 10A–10C show variations of water tubes and/or fuel supply tubes of each example of the present invention. In FIGS. 10A–10C, a suitable number of fins (20) at a suitable height and angle are provided on the fuel supply tube in order to enhance the flame holding capability of the present invention. Any of these fin variations may be applied in combination with any of the tube structures shown in FIGS. 4A–4G or FIGS. 5A–5E.

FIG. 10A shows two fins (20) fit on the water tube (1) at right angles to the direction (93) of the air stream. In this case, 2h+Dw (where h is the height of one fin and Dw is the diameter of the water tube) is equal to the water tube diameter (D) described above.

The number, angle, and height of the fins are changeable by design. FIG. 10B shows two fins (20) fit on the fuel supply tube (4). The fuel injection nozzles (8) are located at the backside of the fins. In this case, the diameter of the fuel supply tube (Dn) is equivalent to Dw described above.

FIG. 10C shows a fin having a variety of openings or holes. U-shaped openings (14) can be provided in the fins (20) of the fuel supply tube, and/or holes (19) can be provided in the fins (20) of the fuel supply tube. In either case, it is better to set the fuel injection nozzles between the openings or holes. The holes (19) should be made larger away from the water tube in order to hold the flame.

EFFECTS OF THE PRESENT INVENTION

Major advantages of the present invention are as follows:

1. The problems of lifting and pulsating combustion which occur in conventional burners are solved. Thus, a wider combustion range, low noise, low NOx, and smaller size and weight of the boilers are achieved.

2. Draft losses in order to uniformly mix air with fuel are drastically reduced since no Combustion burner is necessary in the present invention. This results in a great reduction in dynamic fan force and electrical power usage.

3. Low air ratio combustion by the present invention provides for an improved boiler efficiency and thus energy savings.

4. The NOx value is reduced 10 to 20 ppm, which is impossible in the conventional combustion method. A low excess-air ratio combustion of around 1.0% $O_2$ concentration in the exhausted gas is achieved.

5. It becomes possible to enhance the flame holding function by providing fins in a suitable number and with a suitable height and angle.

6. As explained above, the problems involved in matching burners and boilers in conventional boilers is solved by integrating the burner and boiler functions in the present invention.

What is claimed is:

1. A combustion device comprising:

a boiler having an upstream end and a downstream end;

a water tube nest mounted in said boiler, said water tube nest comprising a plurality of water tubes separated from one another along a downstream direction;

a plurality of fuel supply tubes mounted in said boiler and being spaced upstream from an upstream-most one of said water tubes;

wherein a diameter of each of said fuel supply tubes is substantially equal to a diameter of each of said water tubes; and wherein $L \geqq 3D$, where L is a pitch by which each of said fuel supply tubes is spaced upstream from said upstream-most one of said water tubes and D is said diameter of each of said water tubes.

2. The combustion device according to claim 1, wherein $P \geqq 2D$, where P is a distance by which said water tubes are spaced apart from one another along the downstream direction.

3. The combustion device according to claim 1, wherein said plurality of water tubes are arranged in rows;

said rows of water tubes include an upstream-most row and a second row disposed adjacent and downstream of said upstream-most row; and an ignition device is disposed upstream of said second row of water tubes.

4. The combustion device according to claim 1, wherein said plurality of water tubes are arranged in rows;

said rows of water tubes include an upstream-most row;

said plurality of fuel supply tubes are arranged in a row spaced upstream of said upstream-most row of said water tubes; and an additional row of fuel supply tubes is disposed between two of said rows of water tubes.

5. The combustion device according to claim 1, wherein each of said fuel supply tubes is provided with a plurality of fuel injection nozzles spaced apart at substantially equal pitches along an axial direction of the fuel supply tube; and wherein said fuel injection nozzles are aimed in an upstream direction.

6. The combustion device according to claim 1, wherein each of said fuel supply tubes is provided with a plurality of fuel injection nozzles spaced apart at substantially equal pitches along an axial direction of the fuel supply tube; and wherein said fuel injection nozzles are aimed in a direction substantially perpendicular to a downstream direction.

7. The combustion device according to claim 1, wherein each of said fuel supply tubes is of a double tube construction comprising a fuel tube and a cooling water tube.

8. The combustion device according to claim 1, wherein each of said fuel supply tubes is of a triple tube construction comprising a fuel tube, a combustion air tube and a cooling water tube.

9. The combustion device according to claim 1, wherein each of said fuel supply tubes is at least partially formed of a porous combustion catalyst material.

10. The combustion device according to claim 1, wherein each of said fuel supply tubes comprises an inner tube and a porous outer tube for supplying fuel and combustion air and causing the fuel and air to mix within said fuel supply tube.

11. The combustion device according to claim 1, further comprising protrusions provided on outer surfaces of said fuel supply tubes or said water tubes.

12. The combustion device according to claim 11, wherein said protrusions comprise fins projecting radially from said fuel supply tubes or said water tubes; and openings are formed through said fins.

13. The combustion device according to claim 1, further comprising a combustion catalyst layer mounted amongst said water tube nest across a downstream direction of said boiler.

14. The combustion device according to claim 13, wherein said combustion catalyst layer comprises a corrugated layer.

15. The combustion device according to claim 1, further comprising a plurality of catalyst layers mounted across a downstream direction of said boiler, one of said catalyst layers being disposed upstream of said water tube nest and one of said catalyst layers being disposed amongst said water tube nest.

16. The combustion device according to claim 1, wherein said plurality of water tubes are arranged in rows;

said rows of water tubes include an upstream-most row; and said plurality of fuel supply tubes are arranged in a row spaced upstream of said upstream-most row of said water tubes.

17. The combustion device according to claim 16, wherein $P \geqq 2D$, where P is a distance by which said rows of water tubes are spaced apart from one another along the downstream direction.

18. The combustion device according to claim 16, wherein the pitch by which each of said fuel supply tubes is spaced upstream from said upstream-most one of said water tubes is the same for each of said fuel supply tubes of said row of fuel supply tubes, such that L constitutes a pitch by which said row of fuel supply tubes is spaced upstream of said upstream-most row of said water tubes.

* * * * *